US007328799B2

(12) United States Patent
Eby et al.

(10) Patent No.: US 7,328,799 B2
(45) Date of Patent: Feb. 12, 2008

(54) TASK TRAYS

(75) Inventors: David C. Eby, Madison, WI (US); Gilius A. Gaska, Medina, OH (US); Aaron W. Smith, Wooster, OH (US); Jayson J. Serrault, Middleton, WI (US)

(73) Assignee: Rubbermaid Incorporated, Wooster, OH (US)

( * ) Notice: Subject to any disclaimer, the term of this patent is extended or adjusted under 35 U.S.C. 154(b) by 431 days.

(21) Appl. No.: 10/626,081

(22) Filed: Jul. 24, 2003

(65) Prior Publication Data

US 2005/0016940 A1 Jan. 27, 2005

(51) Int. Cl.
*B65D 1/34* (2006.01)
*B65D 6/04* (2006.01)
*B65D 6/08* (2006.01)

(52) U.S. Cl. ..... 206/515; 206/518; 206/555; 220/605; 220/608

(58) Field of Classification Search ..... 206/515, 206/518, 555; 40/358, 641; D19/91, 92, D19/86; 220/570, 605, 608, 635
See application file for complete search history.

(56) References Cited

U.S. PATENT DOCUMENTS

| | | | |
|---|---|---|---|
| 16,829 | A | 3/1857 | French |
| 399,979 | A | 3/1889 | Dyrenforth |
| 473,540 | A | 4/1892 | Wheeler |
| 712,137 | A | 10/1902 | Jackson |
| 898,034 | A | 9/1908 | Brunn |
| 1,021,598 | A | 3/1912 | Harrington |
| 1,037,607 | A | 9/1912 | Floto |
| 1,119,925 | A | 12/1914 | Chatham |
| 1,211,065 | A | 1/1917 | Brady |
| D55,077 | S | 5/1920 | Page |
| 1,465,244 | A | 8/1923 | Hager |
| D75,658 | S | 6/1928 | Seaton |

(Continued)

FOREIGN PATENT DOCUMENTS

| | | |
|---|---|---|
| FR | 2 277 684 | 2/1976 |

(Continued)

OTHER PUBLICATIONS

International Search Report, dated Mar. 17, 2005 in International application No. PCT/US2004/023792.

(Continued)

*Primary Examiner*—Anthony D. Stashick
*Assistant Examiner*—Niki M. Eloshway
(74) *Attorney, Agent, or Firm*—Marshall, Gerstein & Borun LLP

(57) ABSTRACT

A method and apparatus of organizing a desk top is disclosed. A first tray includes a base with two walls extending upward. A tab extends out from the first wall, and is capable of having indicia disposed thereon. A support wall extends down from the base such that the base is disposed at an angle with respect to the desktop it is placed on, creating a high region and a low region. The upstanding walls extend from the low region. A file may be placed in the low region, then a second tray of similar shape may be placed on top of the first tray, the base of the second tray bearing down on the file retained in the first tray. A stack of files may be sorted and held accordingly.

21 Claims, 5 Drawing Sheets

U.S. PATENT DOCUMENTS 1,734,618 A 11/1929 Frazier
1,890,143 A 12/1932 Bales
1,999,157 A 4/1935 Rand
2,087,786 A 7/1937 Straus
D119,165 S 2/1940 Guild
2,308,654 A 1/1943 Goldstein
2,351,643 A 6/1944 Straus
2,462,789 A 2/1949 Trollen
D158,444 S 5/1950 Converse
2,590,732 A 3/1952 Simancik
D177,186 S * 3/1956 McCarthy ..... D19/92
D179,534 S 1/1957 Bullock et al.
3,515,283 A 6/1970 Poteat
3,876,077 A 4/1975 Jones
D243,524 S 3/1977 Intini
D249,351 S 9/1978 Mattera
4,125,243 A 11/1978 Liptak
D250,960 S 1/1979 Bitner et al.
D254,013 S 1/1980 Intini
D258,293 S 2/1981 Macowski
D260,907 S 9/1981 Giulie et al.
D261,090 S 10/1981 Kapolas
4,378,102 A 3/1983 Portis, Jr.
4,444,314 A 4/1984 Jacobson
4,444,319 A 4/1984 Sharber
D275,771 S 10/1984 Evans
4,512,480 A 4/1985 Evenson
4,706,396 A 11/1987 Nomura
4,712,679 A 12/1987 Lowe
4,726,556 A 2/1988 Weir
4,768,655 A * 9/1988 MacGregor ..... 211/11
4,785,939 A * 11/1988 Huerto et al. ..... 206/511
4,796,847 A 1/1989 Kayner
4,844,264 A * 7/1989 Deskiewicz, Jr. ..... 211/50
4,871,066 A 10/1989 LaWall
D306,529 S 3/1990 Goodell
D309,918 S * 8/1990 Evenson ..... D19/92
D311,931 S * 11/1990 Evenson ..... D19/92
4,974,733 A 12/1990 Evans
D314,566 S 2/1991 Davis et al.
5,022,170 A 6/1991 House
5,025,979 A 6/1991 Dellacroce
D320,045 S 9/1991 Mead
D321,293 S 11/1991 Kucsak
D322,463 S * 12/1991 Hansen ..... D19/92
D325,933 S 5/1992 Torgison
5,123,191 A 6/1992 Kim
D328,103 S 7/1992 Ambasz
5,152,405 A 10/1992 Schriner
5,154,299 A 10/1992 Hwang
5,180,191 A 1/1993 Biba
D333,227 S 2/1993 Horvath
5,203,457 A 4/1993 Garcia
D335,505 S 5/1993 Chan
5,215,198 A 6/1993 Sutton
D341,376 S 11/1993 Feer
D341,377 S 11/1993 Ringle
D349,925 S 8/1994 Charron et al.
5,386,964 A 2/1995 Mayo
D358,611 S 5/1995 Dainoff et al.
D360,777 S 8/1995 Glebe
5,464,095 A 11/1995 Lacayo
D366,170 S * 1/1996 Temple ..... D6/511
5,487,617 A 1/1996 Cole et al.
5,503,435 A 4/1996 Kline
D382,595 S * 8/1997 Raines ..... D19/78
5,657,880 A * 8/1997 Birnbaum ..... 211/50
D388,464 S 12/1997 Najbart
5,699,631 A 12/1997 Tyson
D389,870 S 1/1998 Hart et al.
5,724,757 A * 3/1998 Warden ..... 40/360
5,727,766 A 3/1998 Mayo
D397,360 S 8/1998 Cheris et al.
5,791,620 A 8/1998 Carcich, Jr.
D398,458 S 9/1998 Martell
D399,366 S 10/1998 Stravitz
D401,627 S 11/1998 Markelz et al.
5,857,654 A 1/1999 Berman
D410,452 S 6/1999 Ancona et al.
D410,685 S 6/1999 Thorp et al.
D410,910 S 6/1999 Martell
D413,147 S 8/1999 Ruff et al.
D432,578 S 10/2000 Stravitz
D434,804 S 12/2000 Chang
6,189,705 B1 * 2/2001 Saylor et al. ..... 211/11
D438,568 S 3/2001 Saylor et al.
D439,279 S 3/2001 McColskey et al.
6,227,384 B1 5/2001 Saylor et al.
D443,651 S 6/2001 Chang
D445,136 S * 7/2001 Saylor et al. ..... D19/92
D455,785 S 4/2002 Burns
D468,773 S * 1/2003 Bodum ..... D19/92

FOREIGN PATENT DOCUMENTS

FR 2 540 439 8/1984

OTHER PUBLICATIONS

Written Opinion of the International Searching Authority, dated Mar. 17, 2005, in International Application No. PCT/US2004/023792.

* cited by examiner

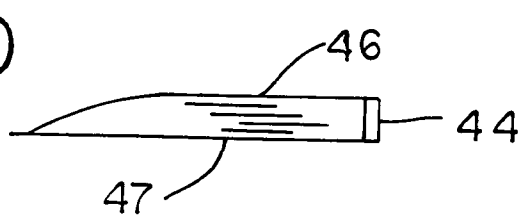
FIG.10
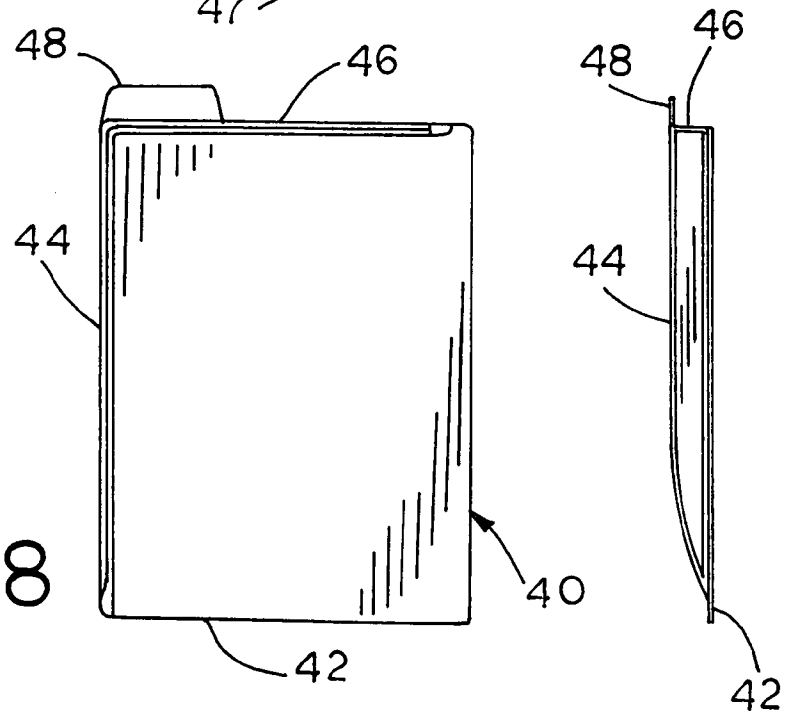
FIG.8
FIG.9
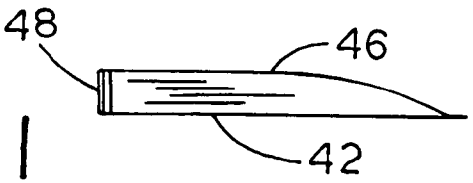
FIG.11
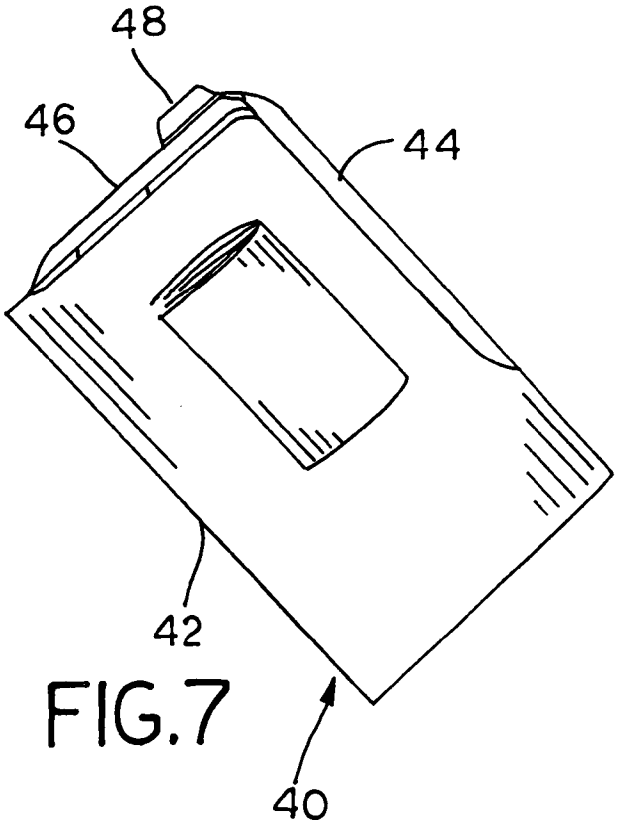
FIG.7

70
72
72a
72b
72c
74
76
77
78
80
82
84
86
88
90
92
94
71

TASK TRAYS

FIELD OF THE DISCLOSURE

The present disclosure relates generally to a method and apparatus of organizing a desktop, and more specifically to trays adapted to retain files on top of a desktop.

BACKGROUND OF THE DISCLOSURE

Research has shown that people organize their work stations in one of two manners, either by piling files on their desk, or by filing them away. Those who pile generally prefer having materials at their fingertips, and prefer not to have the hassle of maintaining a highly organized work area. This is efficient if the user does not have an overbearing number of files on his or her desk. However, it is nearly inevitable that a large number of files will accumulate, and the work space will become inefficient and disorganized.

Research has further shown that various areas of a work space are used, consistently, while others are virtually not used at all. Those who keep files on their desks normally keep the files in the usable space, thereby increasing the clutter and inefficiency of the work space. Those who tend to file papers in an organized manner normally file them in a space that is not used frequently, and therefore the space is generally not easily accessible.

It would be helpful to have a filing system in place that can be maintained in the useful space in the work zone. In particular, it would be helpful for those who pile to have a system which keeps the files located in an organized manner on their desktop, as they prefer. Finally, this filing system should be simple to manufacture, aesthetically pleasing, and cost effective.

BRIEF DESCRIPTION OF THE DRAWINGS

FIG. 7 is an isometric view of a second example of a task tray.

FIG. 8 is a top view of the task tray of FIG. 7.

FIG. 9 is a right side view of the task tray of FIG. 7.

FIG. 10 is a rear view of the task tray of FIG. 7.

FIG. 11 is a front view of the task tray of FIG. 7.

Figure 6:
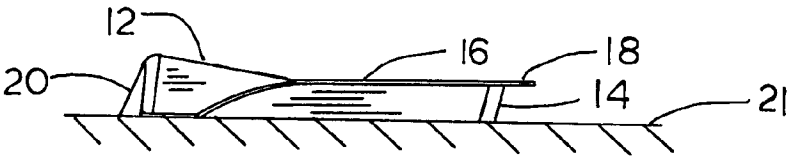
FIG. 6 is a rear view of the task tray of FIG. 1.
Figure 4:
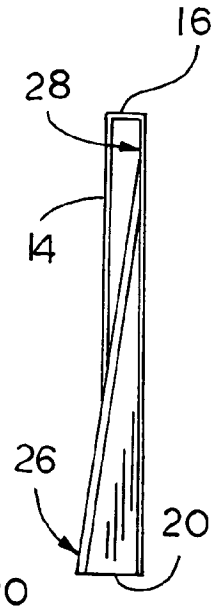
FIG. 4 is a right side view of the task tray of FIG. 1.
Figure 2:
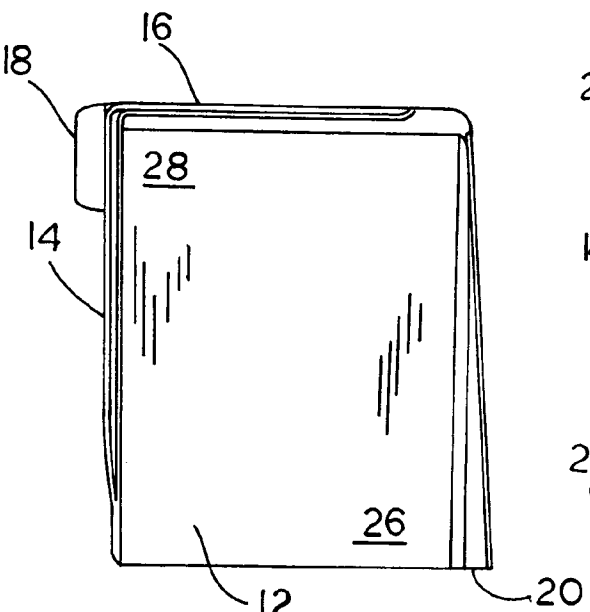
FIG. 2 is a top view of the task tray of FIG. 1.
Figure 5:
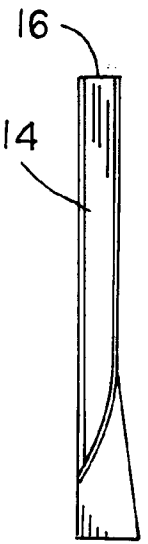
FIG. 5 is a left side view of the task tray of FIG. 1.
Figure 3:
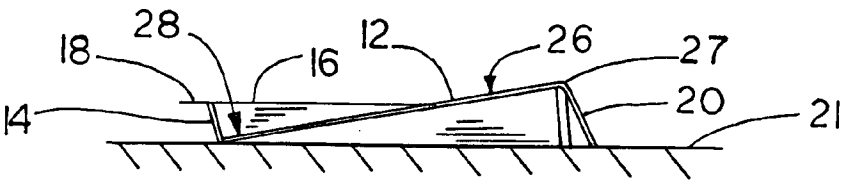
FIG. 3 is a front view of the task tray of FIG. 1.
Figure 1:
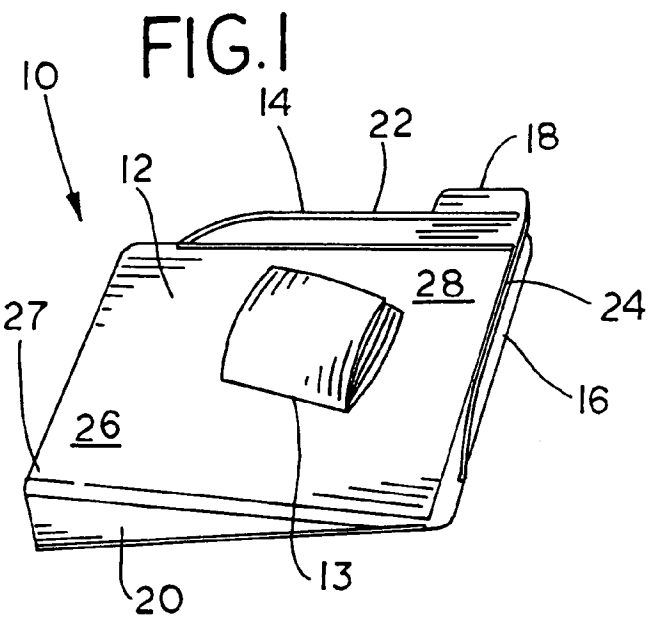
FIG. 1 is an isometric view of a first example of a task tray.
Figure 17:
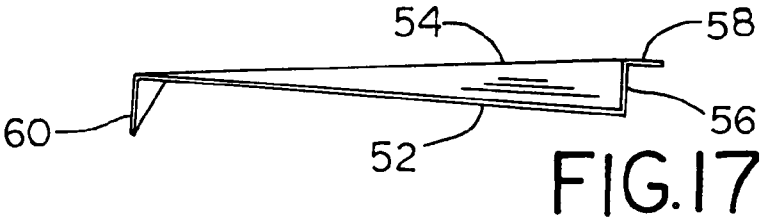
FIG. 17 is a section view of the task tray of FIG. 12 taken along line 17-17.
Figure 14:
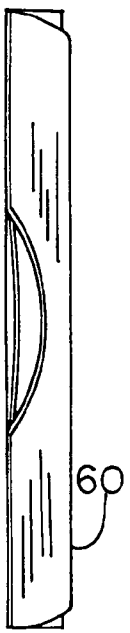
FIG. 14 is a right side view of the task tray of FIG. 12.
Figure 13:
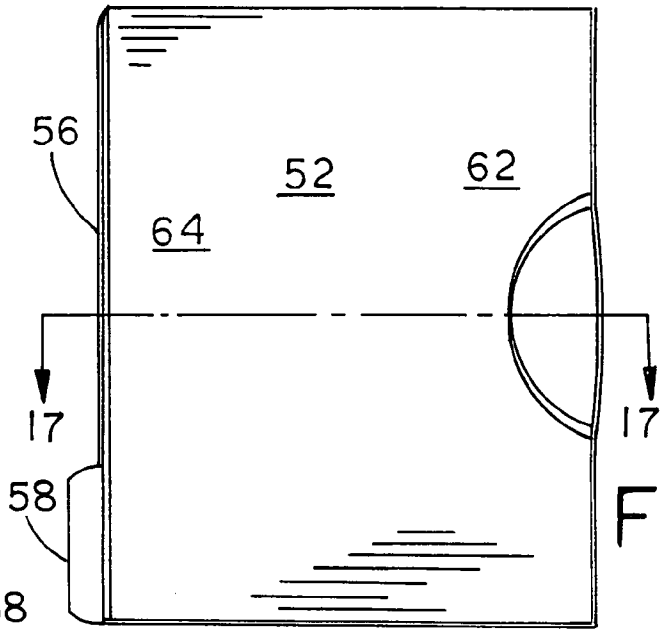
FIG. 13 is a top view of the task tray of FIG. 12.
Figure 15:
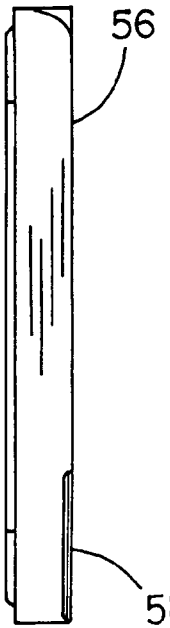
FIG. 15 is a left side view of the task tray of FIG. 12.
Figure 16:
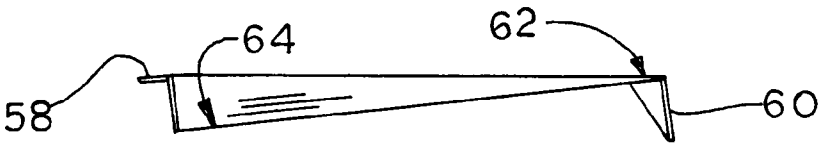
FIG. 16 is a front side view of the task tray of FIG. 12.
Figure 12:
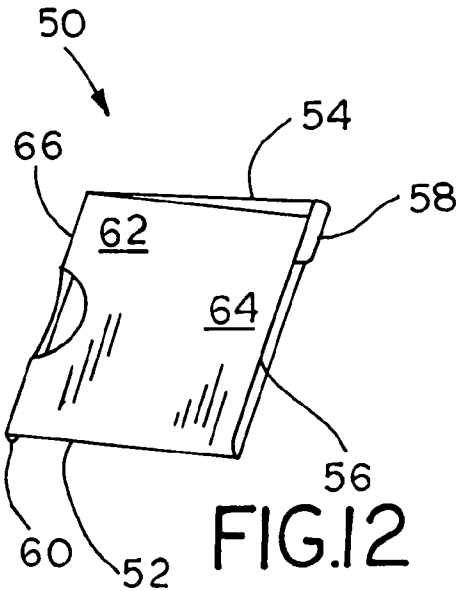
FIG. 12 is an isometric view of a third example of a task tray.

While the disclosure is susceptible to various modifications and alternative constructions, certain illustrative embodiments thereof have been shown in the drawings and will be described below in detail. It should be understood, however, that there is no intention to limit the disclosure to the specific forms disclosed, but on the contrary, the intention is to cover all modifications, alternative constructions, and the equivalents falling within the spirit and scope of the invention as defined by the appended claims.

DETAILED DESCRIPTION

Referring now to the drawings, and particularly to FIGS. 1-6, a first example of a task tray 10 is disclosed. The task tray 10 includes a base 12, which can be plate-like and is configured to support a file 13. While in this example a file 13 is shown, it is clear that any relatively flat item can be supported by the base 12. The tray 10 is configured to be stackable such that other trays, similar or identical in construction to tray 10, may be nested inside tray 10. Further, the dimensions of the task tray 10 can be scaled such that larger files such as legal files or smaller files can be stored.

Extending upwardly from the base 12 are a first wall 14 and a second wall 16. Extending outwardly from the first wall 14 is a tab 18. Extending downwardly from the base 12 is a support wall 20. The tray 10 is generally placed on top of a surface 21 (shown in FIGS. 3 and 6), which can be a desk top, table, or any other surface upon which a file 13 might be placed. In this example the base 12 is approximately square. This can be advantageous in that a rectangular object such as a file of 8½"×11" letter-sized paper can be placed on the base 12 in either portrait or landscape orientation, i.e., the long edge of a piece of paper can be placed adjacent to either the first wall 14 or the second wall 16.

The first wall 14 has a top edge 22, and the second wall 16 has a top edge 24. The tab 18 may be placed in variable positions along the top edges 22, 24 of the first and second walls 14, 16. In this manner, when several trays 10 are stacked, the tabs 18 and all indicia on the tabs 18 have even better visibility. In a further example, all tabs 18 can be visible directly from above due to the placement of the tabs 18. The corners of the tray 10 may also be filleted and radiused to aid in stacking and to present a smooth finish.

The tab 18 is particularly useful for holding indicia that can relate to the file 13 that is being stored. This can include information on the contents or title of the file 13, a date by which the file 13 must be addressed, or other information.

In this example, the support wall 20 is triangular in shape. The base 12 does not lay flat or parallel to the surface 21 on which it is placed, but lays at an angle to the surface 21. It can therefore be seen that a high region 26 is created by the support wall 20, specifically a high point 27, as well as a low region 28, wherein the high point 27 is raised further away from the surface 21 than the low region 28.

The tray 10 can be manufactured from any material that is durable and economical. This includes plastics such as polyethylene and polypropylene. The tray 10 constructed from plastic could be molded as is known in the art or manufactured in any other way known in the art. The tray 10 could also be constructed from wood to increase attractiveness, however, this could be costlier.

In use, a user can place the tray 10 on his or her desk or other work space. The user can then place a file 13, stack of papers, or any other relatively flat item to be stored on the base 12. In this example, the file is 8½"×11", but the tray 10 can be designed to support a file of any dimension. Because of the existence of the high region 26 and the low region 28, gravity will cause the file 13 to slide from the high region 26 to the low region 28. Further, the first wall 14 and the second wall 16 extend upwardly in the low region 28. This helps to capture the file 13 on top of the base 12 and in the tray 10.

Once a tray 10 has a file 13 stored thereon, a second tray (not shown), generally similar to tray 10, can be disposed on top of the tray 10, with the file 13 supporting the second tray from beneath. It is possible that the second tray can be identical to the first tray 10. In this manner, a user can stack or nest several trays 10, one upon the other, with a file 13 in between each of the trays 10. The user can then place indicia on the tab 18 to indicate information about the file 13 in each tray 10. The thickness of the files 13 can aid in increasing the visibility of each tab 18.

Referring now to FIGS. 7-11, a second example of a task tray 40 is shown. The tray 40 includes a base 42 and first and second upstanding walls 44 and 46. Extending off the second upstanding wall 46 is a tab 48.

In the task tray 40, however, the base 42 is disposed flat, such that it sits directly against a workspace that it is placed upon. This may be desirable in that it can distribute its weight evenly over the entire base 42 with no concentrated loads such as along a support wall. The tray 40 can protect against scratches in a wood surface. Some consumers may prefer this example as more aesthetically pleasing because the first and second walls 44 and 46 and the base 42 are disposed at, and intersect at, right angles. This example of a task tray 40 can also be easily stacked, with files interspersed between the trays 40. The bases 42 bear down directly on the files in the stack. The tabs 48 have similar visibility as that previously described for the earlier example.

FIGS. 12-17 shows a third example of a task tray 50. The task tray 50 includes a base 52, and a first upstanding wall 54 and a second upstanding wall 56. A tab 58 extends out from the first upstanding wall 56. Extending down from the base 52 is a support wall 60. This creates a high region 62, and a low region 64. Unlike in the first example, the support wall 60 is not a triangle, but is rectangular in shape. Thus, there is not a point that is highest, but a high edge 66.

The stackability of the task tray 50 is similar to that of task tray 10, and the functions of the tab 58 are also similar.

A fourth example of a task tray 70 is shown in FIGS. 18-21. The tray 70 includes a base 72 in three generally triangular base sections, first section 72*a*, second section 72*b*, and third section 72*c*, and three upstanding walls, first wall 74, second wall 76, and third wall 77. Extending out from the third wall 77 is a tab 78.

Extending downwards from the base 72 is a first support wall 80 and a second support wall 82. The first and second support walls 80 and 82 in this example are generally rectangular with one corner having a large radius. As such, a high region 84 and a low region 86 are formed. The high point of the tray 70 is along high edges 88.

In this example, the first and third base sections 72*a* and 72*c* act as a funnel by allowing gravity to pull files simultaneously down to the second base section 72*b* and to the low region 86 where the files are contained by the first, second, and third upstanding walls 74, 76, and 77. This example also includes convenient curved handle sections 90 for aiding the user in grasping and manipulating the task tray 70.

Figures 18, 19, 20, 21, 22:
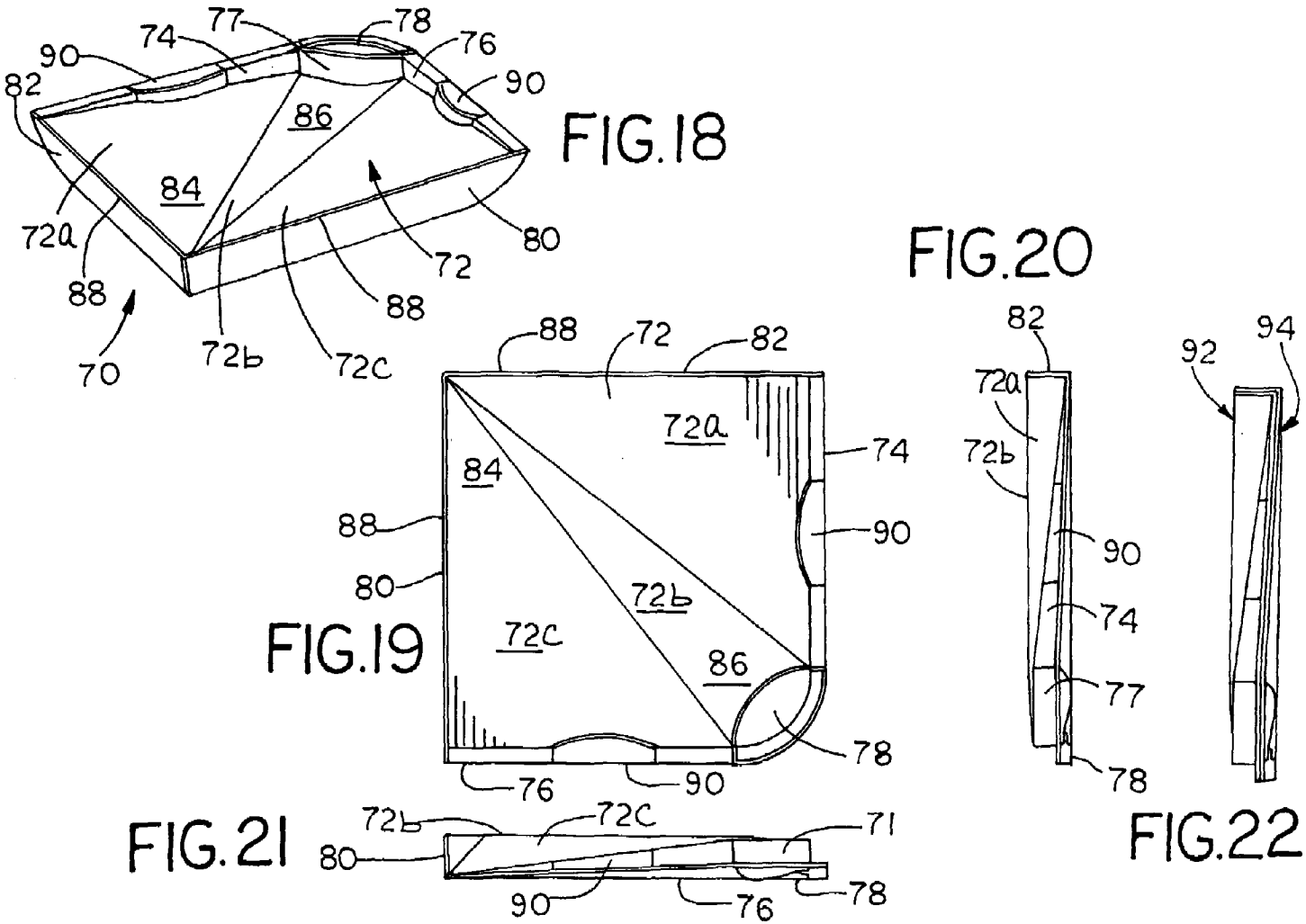
FIG. 18 is an isometric view of a fourth example of a task tray.
FIG. 19 is a top view of the task tray of FIG. 18.
FIG. 20 is a right side view of the task tray of FIG. 18.
FIG. 21 is a front view of the task tray of FIG. 18.
FIG. 22 is a right side view of a plurality of task trays of FIG. 18 in a nested configuration.

FIG. 22 shows an example of two task trays 92 and 94, having similar construction as the task tray 70, the task trays 92 and 94 being stacked upon each other. Each of the afore described examples work in a similar manner of stacking, wherein the shape of the trays facilitates such nesting. The base 72 of the top tray 94 bears down directly on the file being stored in the bottom tray 92. The upstanding walls 74 and 76 of the bottom tray 92 interact with the upstanding walls 74 and 76 of the top tray 94 such that no part of the file may escape between the upstanding walls of the top tray 94 and the bottom tray 92. In this example, the walls 74, 76 of the top tray 94 and the walls 74, 76 of the bottom tray 92 contact each other.

Figure 23:
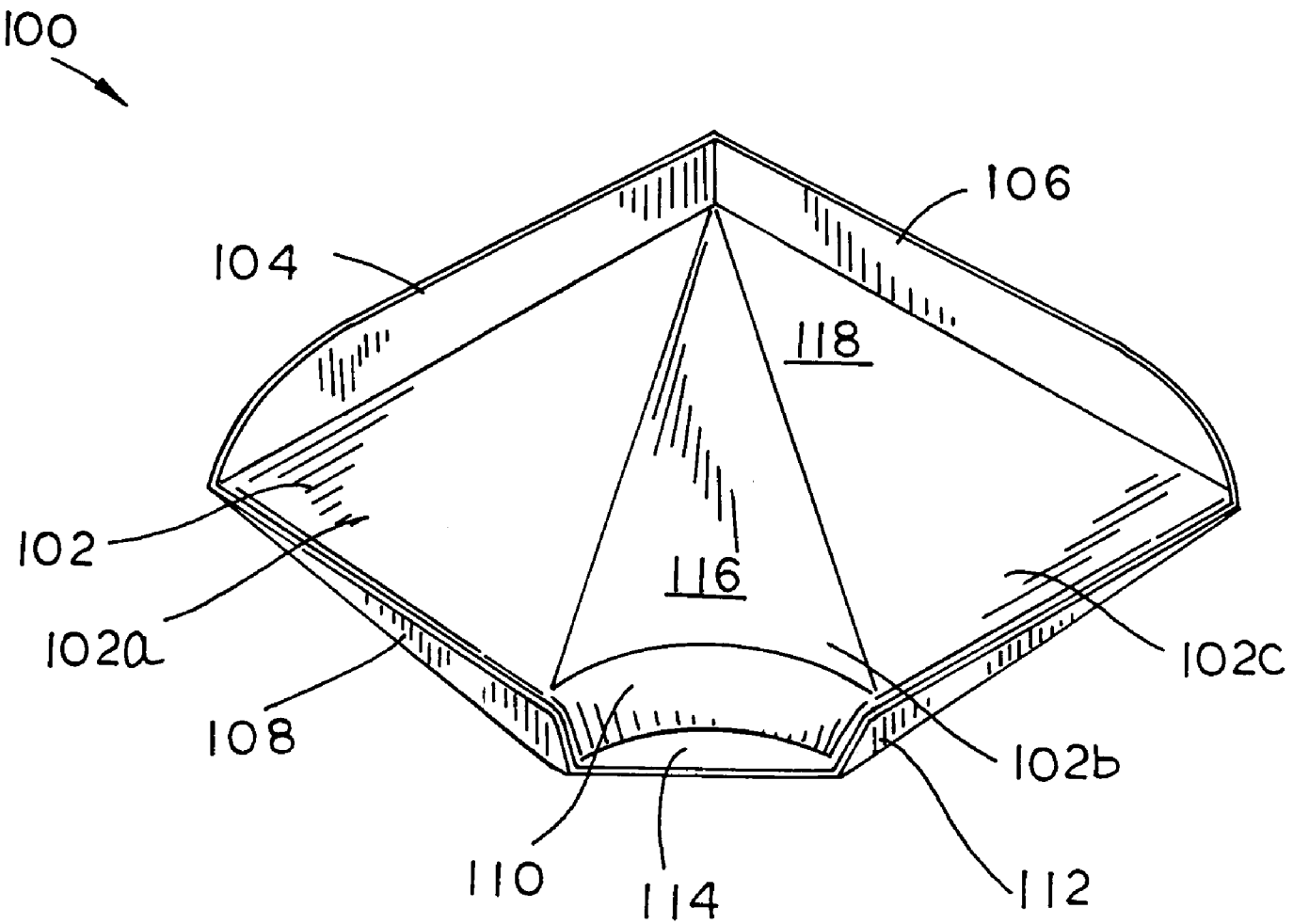
FIG. 23 is an isometric view of a fifth example of a task tray.

A fifth example of a task tray 100 is disclosed in FIG. 23. The tray 100 includes a base 102, with generally triangular base sections, first section 102*a*, second section 102*b*, and third section 102*c*. Extending up from the base 102 are first and second sidewalls 104 and 106. Extending downward from the base are first, second, and third support walls 108, 110, and 112. In this example, the tab 114 extends outwardly from the second support wall 110. Again, a high region 116 and a low region 118 are formed. Thus, a file to be stored in the tray 100 is retained by gravity drawing the file from the high region 116 to the low region 118, until it abuts the first and second upstanding walls 104 and 106.

From the foregoing, one of ordinary skill in the art will appreciate that the present disclosure sets forth a method and apparatus for organizing a desktop. However, one of ordinary skill in the art could readily apply the novel teachings of this disclosure to any number of apparatuses. As such, the teachings of this disclosure shall not be considered to be limited to the specific examples disclosed herein, but to include all applications within the spirit and scope of the invention.

What is claimed is:

1. An apparatus for organizing a desktop, comprising:

a base having a plurality of edges;

a first sidewall extending upwardly from a first edge of the base; and a second sidewall extending upwardly from a second edge of the base, wherein the first edge is adjacent the second edge, the first sidewall and the second sidewall forming a first angle therebetween; and a support wall extending downward from the base, wherein the base is open on edges disposed opposite the first and second edges;

the first sidewall and the first edge each mirror the second sidewall and the second edge, respectively, about a line that bisects the first angle, and a bottom edge of the support wall is not parallel to the base.

2. The apparatus of claim 1, wherein the first and second sidewalls are disposed at right angles to each other.

3. The apparatus of claim 2, wherein the first sidewall is the same length as the second sidewall.

4. The apparatus of claim 1, wherein the base is adapted to support at least an 8½"×11" file.

5. The apparatus of claim 1, wherein at least a portion of the base is disposed at an angle to the desk top, thereby forming a high region and a low region of the base.

6. The apparatus of claim 5, wherein the support wall supports the angular disposition of the base.

7. The apparatus of claim 6, wherein the support wall extends downwardly from the high region.

8. The apparatus of claim 5, wherein the base is connected to the first and second sidewalls at least in the low region, such that any item placed on the base will be retained in the low region by the upstanding sidewalls.

9. The apparatus of claim 8, wherein the first and second sidewalls and the base intersect.

10. The apparatus of claim 1, wherein the base is approximately square.

11. An apparatus for organizing a desktop, comprising:

a base;

a first sidewall extending upwardly from the base; and a second sidewall extending upwardly from the base;

wherein the base includes a first triangular panel, a second triangular panel, and a third triangular panel, the second triangular panel disposed between the first and third triangular panels, the first triangular panel and the third triangular panel each sloping to meet the second triangular panel, and the first triangular panel mirroring the third triangular panel.

12. The apparatus of claim 11, wherein the first and second sidewalls are disposed at right angles to each other.

13. The apparatus of claim 11, wherein the base is adapted to support at least an 8½"×11" file.

14. The apparatus of claim 11, wherein the first and third panels are disposed at an angle to the desk top, each of the first and third sidewalls thereby forming a high region and a low region.

15. The apparatus of claim 14, further including a support wall extending downwardly from the base, thereby supporting the angular disposition of the base.

16. The apparatus of claim 15, wherein the support wall extends downwardly from the high region.

17. The apparatus of claim 11, wherein the base is connected to the first and second sidewalls at least in the low region, such that any item placed on the base will be contained in the low region by the upstanding sidewalls.

18. The apparatus of claim 17, wherein the first and second sidewalls and the base intersect.

19. The apparatus of claim 18, wherein the base is approximately square.

20. The apparatus of claim 11, wherein the first triangular panel is coupled to and extends away from the first sidewall, and the third triangular panel is coupled to and extends away from the second sidewall.

21. An apparatus for organizing a desktop, comprising:

a base having a plurality of outer edges and including a first panel and a second panel, the first panel sloping to meet the second panel;

a first sidewall extending upwardly from a first edge of the base; and a second sidewall extending upwardly from a second edge the base, the edges of the base opposite the first and second sidewall having no sidewall extending upwardly therefrom;

wherein the first panel is coupled to and extends away from the first sidewall and the second panel is generally triangular in shape, wherein the apparatus is symmetrical about a line bisecting the second triangular panel.

* * * * *